US007207392B2

(12) United States Patent
Kotliar

(10) Patent No.: US 7,207,392 B2
(45) Date of Patent: Apr. 24, 2007

(54) METHOD OF PREVENTING FIRE IN COMPUTER ROOM AND OTHER ENCLOSED FACILITIES

(75) Inventor: Igor K. Kotliar, New York, NY (US)

(73) Assignee: FirePass IP Holdings, Inc., New York, NY (US)

( * ) Notice: Subject to any disclaimer, the term of this patent is extended or adjusted under 35 U.S.C. 154(b) by 25 days.

(21) Appl. No.: 11/199,770

(22) Filed: Aug. 8, 2005

(65) Prior Publication Data

US 2006/0213673 A1 Sep. 28, 2006

Related U.S. Application Data

(63) Continuation of application No. 10/726,737, filed on Dec. 3, 2003, and a continuation of application No. 10/078,988, filed on Feb. 19, 2002, now Pat. No. 6,557,374, and a continuation of application No. 10/024,079, filed on Dec. 17, 2001, now Pat. No. 6,560,991, and a continuation-in-part of application No. 09/975,215, filed on Oct. 10, 2001, now Pat. No. 6,502,421, and a continuation-in-part of application No. 09/854,108, filed on May 11, 2001, now Pat. No. 6,401,487, and a continuation-in-part of application No. 09/750,801, filed on Dec. 28, 2000, now Pat. No. 6,418,752, and a continuation of application No. 09/566,506, filed on May 8, 2000, now Pat. No. 6,334,315, and a continuation of application No. 09/551,026, filed on Apr. 17, 2000, now Pat. No. 6,314,754.

(51) Int. Cl.
*A62C 2/00* (2006.01)

(52) U.S. Cl. ..... 169/45; 169/43; 169/54; 169/56; 62/78; 62/643; 252/2

(58) Field of Classification Search ..... 169/43, 169/45, 54, 56; 62/78, 640, 641, 643; 128/200.24, 128/202.12, 205.11; 252/2
See application file for complete search history.

(56) References Cited

U.S. PATENT DOCUMENTS

| | | | |
|---|---|---|---|
| 3,948,626 | A | 4/1976 | Bragg |
| 4,378,920 | A | 4/1983 | Runnels |
| 4,556,180 | A | 12/1985 | Manatt |
| 4,681,602 | A | 7/1987 | Glenn |
| 4,896,514 | A | 1/1990 | Sugiyama et al. |
| 5,063,753 | A | 11/1991 | Woodruff |
| 5,220,799 | A | 6/1993 | Lievens et al. |
| 5,273,344 | A | 12/1993 | Volkwein et al. |
| 5,308,382 | A | 5/1994 | Prasad |

(Continued)

OTHER PUBLICATIONS

William M. Cavage, Federal Aviation Administration, Atlantic City, NJ, and Timothy Bowman, Boeing Phantom Works, St. Louis, MO, *Modeling In-flight Inert Gas Distribution in a 747 Center Wing Fuel Tank*, AIAAFDC32143b.pdf, 598 Kb, 13 pages, FAA White Papers.

(Continued)

*Primary Examiner*—Steven J. Ganey

(57) ABSTRACT

Methods are provided for a provision of hypoxic hypercapnic and hypoxic hypocapnic fire-extinguishing compositions for continuous use in human occupied environments. Breathable fire preventative atmospheres can be created using air separation and having increased or decreased carbon dioxide content.

16 Claims, 3 Drawing Sheets

U.S. PATENT DOCUMENTS

| | | | | |
|---|---|---|---|---|
| 5,388,413 | A | | 2/1995 | Major et al. |
| 5,472,480 | A | | 12/1995 | Barbe |
| 5,649,995 | A | | 7/1997 | Gast, Jr. |
| 5,730,780 | A | | 3/1998 | Booth, III |
| 5,794,457 | A | * | 8/1998 | Magnet et al. ..... 62/643 |
| 5,799,495 | A | | 9/1998 | Gast, Jr. et al. |
| 5,799,652 | A | * | 9/1998 | Kotliar ..... 128/205.11 |
| 5,921,091 | A | | 7/1999 | Foss et al. |
| 6,012,533 | A | | 1/2000 | Cramer |
| 6,112,822 | A | | 9/2000 | Robin et al. |
| 6,314,754 | B1 | | 11/2001 | Kotliar |
| 6,334,315 | B1 | | 1/2002 | Kotliar |
| 6,401,487 | B1 | | 6/2002 | Kotliar |
| 6,418,752 | B2 | | 7/2002 | Kotliar |
| 6,547,188 | B2 | | 4/2003 | Schmutz et al. |
| 6,604,558 | B2 | | 8/2003 | Sauer |
| 6,634,598 | B2 | | 10/2003 | Susko |
| 6,729,359 | B2 | | 5/2004 | Jones |
| 6,739,359 | B2 | | 5/2004 | Jones et al. |
| 6,739,399 | B2 | | 5/2004 | Wagner |
| 6,739,400 | B2 | | 5/2004 | Lessi et al. |

OTHER PUBLICATIONS

William M. Cavage, Fire Safety Branch, Federal Aviation Administration, William J. Hughes Technical Center, Atlantic City International Airport, NJ, *Modeling of In-flight Fuel Tank Inerting for FAA OBIGGS Research*, 255 Kb, 11 pages, FAA White Papers.

William M. Cavage and Robert Morrison, Fire Safety Branch, Federal Aviation Administration, William J. Hughes Technical Center, Atlantic City Int'l Airport, NJ, *Development and Testing of the FAA Simplified Fuel Tank Inerting System*, Cavage-FAAOBIGGSDevelop&Test, 530 Kb, 11 pages, FAA White Papers.

Steven M. Summer, *Limiting Oxygen Concentration Required to Inert Jet Fuel Vapors Existing at Reduced Fuel Tank Pressures*, Aug. 2003, DOT/FAA/AR-TN02/79, 1.8 Mb, 32 pages, FAA White Pages.

William M. Cavage, Fire Safety Branch, Federal Aviation Administration, AAR-422, Building 204, William J. Hughes Technical Center, Atlantic City International Airport, NJ, *Ground-Based Inerting of Commercial Transport Aircraft Fuel Tanks*, RTO_AVT-GBI Paper 761 Kb, 20 pages, FAA White Papers.

William M. Cavage, Fire Safety Section, Federal Aviation Administration, Atlantic City International Airport, NJ, *Modeling Inert Gas Distribution in Commercial Transport Aircraft Fuel Tanks*, AIAA Paper 2002-3032, Report 1300, 600 Kb, 8 pages, FAA White Papers.

Charles C. Graves and Donald W. Bahr, FAA-Propulsion Chemistry Division, *Basic Considerations in the Combustion of Hydrocarbon Fuels with Air*, NACA -1300, 24.04 Mb 26, 267 pages, FAA White Papers.

William M. Cavage, FAA, AAR-422, Fire Safety R&D, Copyright @ 2001 Society of Automotive Engineers, Inc., *Ground-Based Inerting of a Boeing 737 Center Wing Fuel Tank*, SAE-GBI, 281 Kb, 8 pages, FAA White Papers.

Michael Burns, William M. Cavage, Federal Aviation Administration, William J. Hughes Technical Center, Airport and Aircraft Safety, Research And Development Division, Atlantic City Int'l Airport, NJ 08405, *Ground and Flight Testing of a Boeing 737 Center Wing Fuel Tank Inerted With Nitrogen-Enriched Air* DOT/FAA/AR-01/63, 4.91 Mb, 34 pages, FAA White Papers.

Samuel v. Zinn, Jr., Nat'l Aviation Facilities Experimental Center, Atlantic City, NJ, *Inerted Fuel Tank Oxygen Concentration Requirements*, Aug. 1971, FAA-RD-71-42 1.58 Mb, 23 pages, FAA White Papers.

Thomas L. Reynolds, et al., Boeing Commercial Airplanes Group, Seattle, Wash., *Onboard Inert Gas Generation System/Onboard Oxygen Gas Generation System*, May 2001, (OBIGGS/OBOGS) Study NASA/CR-2001-210903 7.75 Mb, 179 pages, FAA White Papers.

Michael Burns and William M. Cavage, Federal Aviation Administration, FAA William J. Hughes Technical Center, Airport and Aircraft Safety, Research and Development Division, Atlantic City Int'l. Airport, NJ, *Inerting of a Vented Aircraft Fuel Tank Test Article With Nitrogen Enriched Air*, Apr. 2001, 2.28 Mb., 29 pages, FAA White Papers.

Steven M. Summer, *Cold Ambient Temperature Effects on Heated Fuel Tank Vapor Concentrations*, Jul. 2000, DOT/FAA/AR-TN99-93, 395 Kb, 13 pages, FAA White Papers.

William M. Cavage, Airport and Aircraft Safety, Research and Development Division, FAA William J. Hughes Technical Center, Atlantic City International Airport, NJ, May 2000, *The Cost of Implementing Ground-Based Fuel Tank Inerting in the Commercial Fleet*, DOT/FAA/AR-00/19, 941 Kb, 60 pages, FAA White Papers.

*A Benefit Analysis for Nitrogen Inerting of Aircraft Fuel Tanks Against Ground Fire Explosion*, Dec. 1999, Final Report, DOT/FAA/AR-99/73 Office of Aviation Research, NTIS, Springfield, VA, 617 Kb, 117 pages.

Steveb M. Summers, *Mass Loading Effects on Fuel Vapor Concentrations in an Aircraft Fuel Tank Ullage*, Sep. 1999, DOT/FAA/AR-TN99/65, 934 Kb, 14 pages.

*A Review of the Flammability Hazard of Jet A Fuel Vapor in Civil Transport Aircraft Tanks*, Jun. 1998, Final Report, DOT/FAA/AR-98/26, 1.04 Mb, 62 pages, FAA White Papers.

Aircraft Accident Report, *In-Flight Breakup Over the Atlantic Ocean Trans World Airlines Flight 800*, National Transportation Safety Board, NTSB/AAR-00/03 7.63 Mb, 341 pages.

Daniel R. Bower, Ph.D., *Flight Test Group Chairman's Factual Report of Investigation*, Jul. 17, 1996, NTSB/SA-516, 96 Kb, 24 pages, FAA White Papers.

Ivor Thomas, *FAA R&D Efforts on Flammability*, Aug. 14, 2002, 2.3 Mb, 27 pages, FAA White Papers.

Alan Levin, *Lower cost, higher risk helped alter FAA stance*, (McLean, VA: Feb. 17, 2004. p. A.03), Copyright 2004 Gannett Company, Inc., USA Today.

Alan Levin, *FAA Suggests Airbus Modify Jets to Reduce Risks; Fuel Tanks Scrutinized*, (McLean VA: Nov. 19, 2003 p. B.03), Final Edition, Copyright 2003 Gannett Company, Inc., USA Today.

Alan Levin, *Jets Must Be Altered, Device Created to Stop Fuel-Tank Explosions*, (McLean VA: Feb. 17, 2004 p. A.01), Final Edition, Copyright 2004 Gannett Company, Inc., USA Today.

Alan Levin, *FAA Device Could Guard Against Terrorism; Experts: Fuel-tank System Could Help Jets Survive Missle Attack* (McLean Va: Feb. 18, 2004, p. A.03), Final Edition, Copyright 2003 Gannett Company, Inc., USA Today.

David Evans, *Safety* v. *Entertainment*, (Feb. 1, 2003) Avionics Magazine.

Peg Hashem, *Hamilton Sundstrand and Two Units of Cobham to Supply Nitrogen Generation System for Boeing 7E7*, Hamilton Sundstrand, A United Technologies Company, Windsor Locks, Conn., Corporate Press Release (Jul. 1, 2004).

Andrew J. Peacock, *Oxygen at High Altitude*, BMJ 1998; 317:1063-1066 (Oct. 17).

Peter W. Hochachka, *Mechanism and Evolution of Hypoxia-Tolerance in Humans*, The Journal of Experimental Biology 201, 1243-1254 (1998).

J. Hardy Tyson and John F. Barnes, *The Effectiveness Of Ullage Nitrogen-Inerting Systems Against 30-mm High-Explosive Incendiary Projectiles*, Naval Weapons Center, China Lake, CA, Report JTCG/AS-90-T-004, (May 1991).

* cited by examiner

METHOD OF PREVENTING FIRE IN COMPUTER ROOM AND OTHER ENCLOSED FACILITIES

This application is a continuation of U.S. Patent applications: U.S. Ser. No. 10,726,737, filed Dec. 3, 2003, U.S. Ser. No. 09/551,026, filed Apr. 17, 2000, now U.S. Pat. No. 6,314,754, and U.S. Ser. No. 09/566,506, filed May 8, 2000, now U.S. Pat. No. 6,334,315, a CIP of U.S. Ser. No. 09/854,108, filed May 11, 2001, now U.S. Pat. No. 6,401,487, a CIP of U.S. Ser. No. 09/750,801, filed Dec. 28, 2000, now U.S. Pat. No. 6,418,752, a CIP of U.S. Ser, No. 09/975,215, filed Oct. 10, 2001, now U.S. Pat. No. 6,502,421, a continuation of U.S. Ser. No. 10/078,988, filed Feb. 19, 2002, now U.S Pat. No. 6,557,374, and a continuation of U.S. Ser. No. 10/024,079, filed Dec. 17, 2001, now U.S. Pat. No. 6,560,991.

RELATED APPLICATIONS

This invention is related to preceding U.S. Pat. No. 5,799,652 issued Sep. 1, 1998, U.S. Pat. No. 5,887,439 issued Mar. 30, 1999 and U.S. Pat. No. 5,924,419 of Jul. 20, 1999.

FIELD OF THE INVENTION

The present invention relates to a method for providing low-oxygen (hypoxic) environments in computer rooms and other human occupied facilities in order to prevent and suppress fire before it starts.

The demand in reliable fire prevention and suppression systems for industrial applications has been growing extensively in last years, especially with the explosive development of Internet, computerized equipment and communication systems. The invented method can be used in any possible application where a human occupied environment requires protection from fire hazard or explosion.

DESCRIPTION OF THE PRIOR ART

At the present time there are no products on the market that would allow preventing fire from igniting in computer rooms, warehouses or other human-occupied facilities. Multiple computers and servers stocked in one room produce a lot of heat mainly due to friction and overheating of electronic components. At any time a malfunction of an electronic component or short circuit may cause fire and extensive damage. The only measures that being taken in the direction of fire prevention is extensive cooling of the computer room environment, which doesn't help when a fire starts. It means that there is no technology to provide a reliable fire preventive environment in a computer room or whole building filled with computerized equipment or combustible materials.

Current fire suppression systems are destructive for computerized equipment and hazardous for human operators. Even in a case of a small fire such systems start spraying water or foam that completely destroy computers or produce gases or chemicals that may suppress fire for a limited time but may be toxic and environmentally destructive.

There are many thousands such computer rooms in the U.S. only, owned by large corporations, banks, communication companies, military and government agencies, many of them loosing millions of dollars in just one such fire.

Most usable fire fighting systems employ water, dry or liquid chemicals and gaseous agents, such as Halon 1301, carbon dioxide or heptafluoropropane, and mixtures of different gases, most of them are ozone depleting, toxic and environmentally unfriendly.

PRIOR ART PATENTS

U.S. Pat. Nos. 3,948,626; 4,378,920; 4,681,602; 4,556,180 and 5,730,780 describe methods and systems for inserting aircraft fuel tanks with "combustibly inert gas" which cannot contain more than 7%, 8% or 9% of oxygen. These numbers are based on poorly done research and not understanding the difference between combustion suppression and ignition prevention. This important difference is described in detail in inventor's previous U.S. Pat. Nos. 6,314,754; 6,334,315; 6,401,487; 6,418,752 that can be added now to prior art as well. Recent U.S. Pat. No. 6,739,399 describes another application of a two-stage inserting using nitrogen gas, which might be very dangerous in case of a failure of electronic controls.

SUMMARY OF THE INVENTION

A principal object of this invention is to provide methods for producing a breathable fire-preventative hypoxic environment inside a room or facility containing computerized equipment or any combustible, inflammable or explosive materials.

Another object of the invention is a method to provide hypoxic hypercapnic fire-extinguishing compositions for continuous use in human occupied environments.

Further object of the invention is a method to provide hypoxic hypocapnic fire-extinguishing compositions for continuous use in human occupied environments.

DESCRIPTION OF THE INVENTION

This invention is based on a discovery made by the inventor during research with the Hypoxic Room System made by Hypoxico Inc. in New York. The principle was described in detail in previous U.S. Pat. Nos. 6,314,754; 6,334,315; 6,401,487; 6,418,752, 6,502,421, 6,557,374, 6,560,991.

Figure 1:
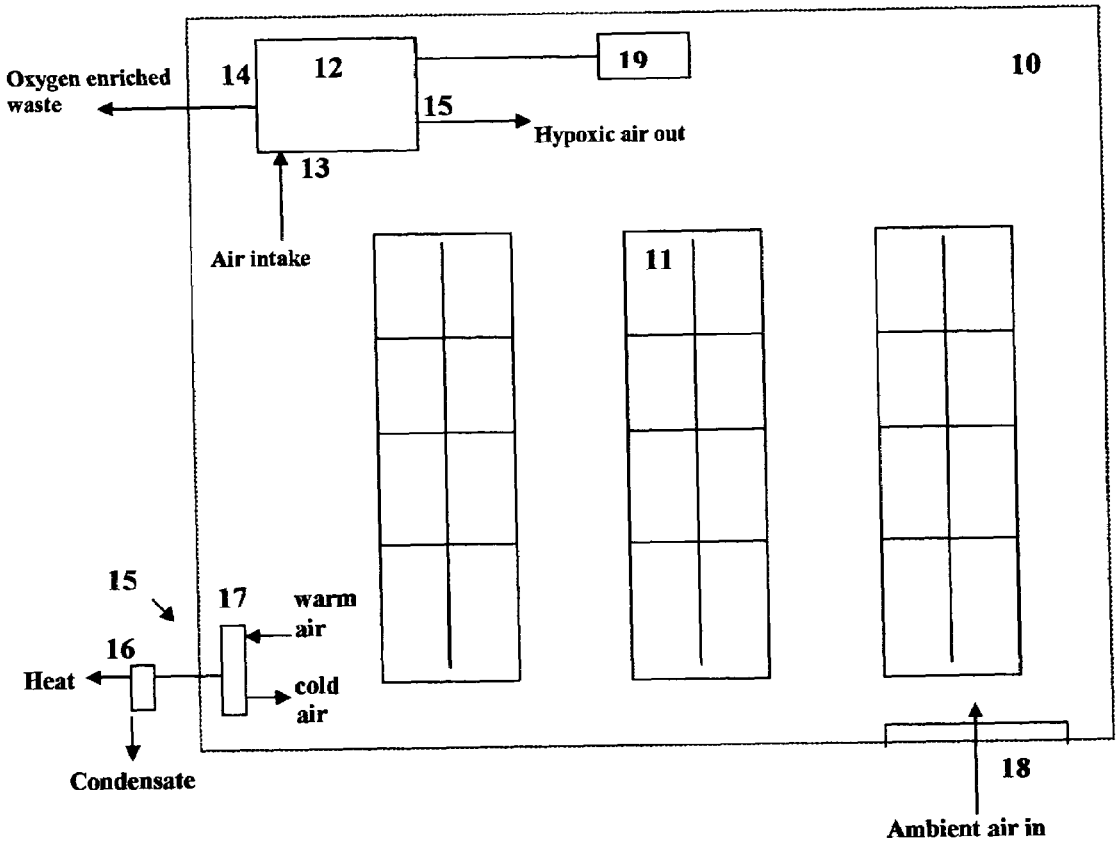
FIG. 1 illustrates schematically a working principle and a method of establishing a breathable normobaric hypoxic fire prevention environment in a computer room, warehouse or other normally occupied facility.

FIG. 1 presents a schematic view of a fire protected room or enclosure 10 for computer equipment or storage of inflammable materials.

Racks 11 with computer equipment or inflammable material located in room 10, are exposed to a normobaric hypoxic environment with oxygen concentration about 15% (that corresponds to an altitude of 9,000' or 2,700 m) but at standard atmospheric pressure. Such normobaric hypoxic environment provides absolute fire safety by preventing combustible materials from inflammation.

Hypoxic environments having 16% to 18% oxygen content can also provide limited protection from fire hazards. It is advisable to provide normobaric hypoxic environments with oxygen concentration from 15% to 17% for public areas (e.g. museums and archives) and 14% to 15% oxygen content for human occupied facilities that require superior fire protection. Facilities that require only short periodical human visits may employ environments with oxygen content ranging from 14% to 12% corresponding to altitudes from 3 km or 10,000' to 4.5 km or 14,500'. Hypoxic atmosphere with oxygen concentrations from 9% to 12% can be used for extremely hazardous (explosive) environments and they are still breathable and accessible for a reduced period of time.

An air separation device 12 installed inside room 10 intakes internal air through the intake 13 and separates it into an oxygen-enriched fraction and oxygen-depleted fraction. The oxygen-enriched fraction is removed from room 10 through disposal outlet 14. The oxygen-depleted fraction is released inside room 10 through supply outlet 15. The continuous release of the oxygen-enriched fraction causes a slight drop in atmospheric pressure inside the room 10 that in turn causes the same amount of outside air to enter the room through existing gaps (e.g. around the door, etc.) in order to equalize atmospheric pressure inside room 10 with the outside environment. Device 12 can be adjusted to remove pure oxygen from the internal atmosphere of room 10 in order to minimize the amount of air to be drawn inside during pressure equalization. Other possibilities of the equipment installation are described in the previous U.S. Pat. Nos. 5,799.652 and 5,887.439.

Air separation device 12 can employ membrane, pressure-swing or temperature-swing absorption principle. Cryogenic and other air separation technologies are usable as well. Suitable devices called hypoxic generators are available from Hypoxico Inc. and FirePASS Corporation in New York.

Control panel 19 consists of an oxygen monitor with High and Low alarm output and communicating with an electronic control circuit or relay. Air separation device is wired to the power supply through this control circuit so that when oxygen content in the room 10 drops to the Low set level, the power supply is interrupted and device 12 is shut down. Depending on the leakage rate of the room 10, the oxygen content in the internal atmosphere will eventually rise to the High set level, which will trigger the control panel 19 to resume the power supply and turn on the device 12. This happens also when someone opens the door 18, which causes oxygen content to rise to the High set level, starting device 12.

Device 12 continues extraction of the oxygen-enriched fraction form room 10 until the oxygen concentration reached Low set level, which detected by the monitor in control panel 19, shuts down the device 12. This cycle continues repeatedly, which allows to save energy and maintain oxygen concentration in desired range between High and Low set levels, for instance, between 14% (Low set level) and 15% (High set level). Low set level can be chosen, depending on application, between 9% and 16% O2 and High set level—between 10% and 17% of oxygen.

The hypoxic air inside computer room 10 is constantly chilled by a split air-conditioning unit 15 having external heat exchanger part 16 connected to internal air recycling unit 17. Warm air enters unit 17, where it gets chilled and is released back into room 10. Hot refrigerant and water condensate from air are transmitted into external unit 16, where refrigerant gets chilled and condensate evaporated or removed. The working principle of a split a/c unit is well known and shall not be described in this work. A suitable device—PAC 400 is made by DeLonghi in Italy. Larger split a/c systems are also available worldwide. Other than computer room facilities may not require air conditioning at all.

A capacity or number of air separation devices 12 needed for room 10 depends on the size of a room and a number of operators working at a time in the room. The best device suitable for 1000 $ft^3$ or 28 $m^3$ room would be hypoxic generator FP-123 that is available from FirePASS Corporation in New York. FP-123 employs PSA (pressure-swing adsorption) technology in order to extract part of oxygen from ambient air. This compact unit weighting only 55 lbs or 25 kg requires only 500 W and is nearly maintenance free.

Figure 2:
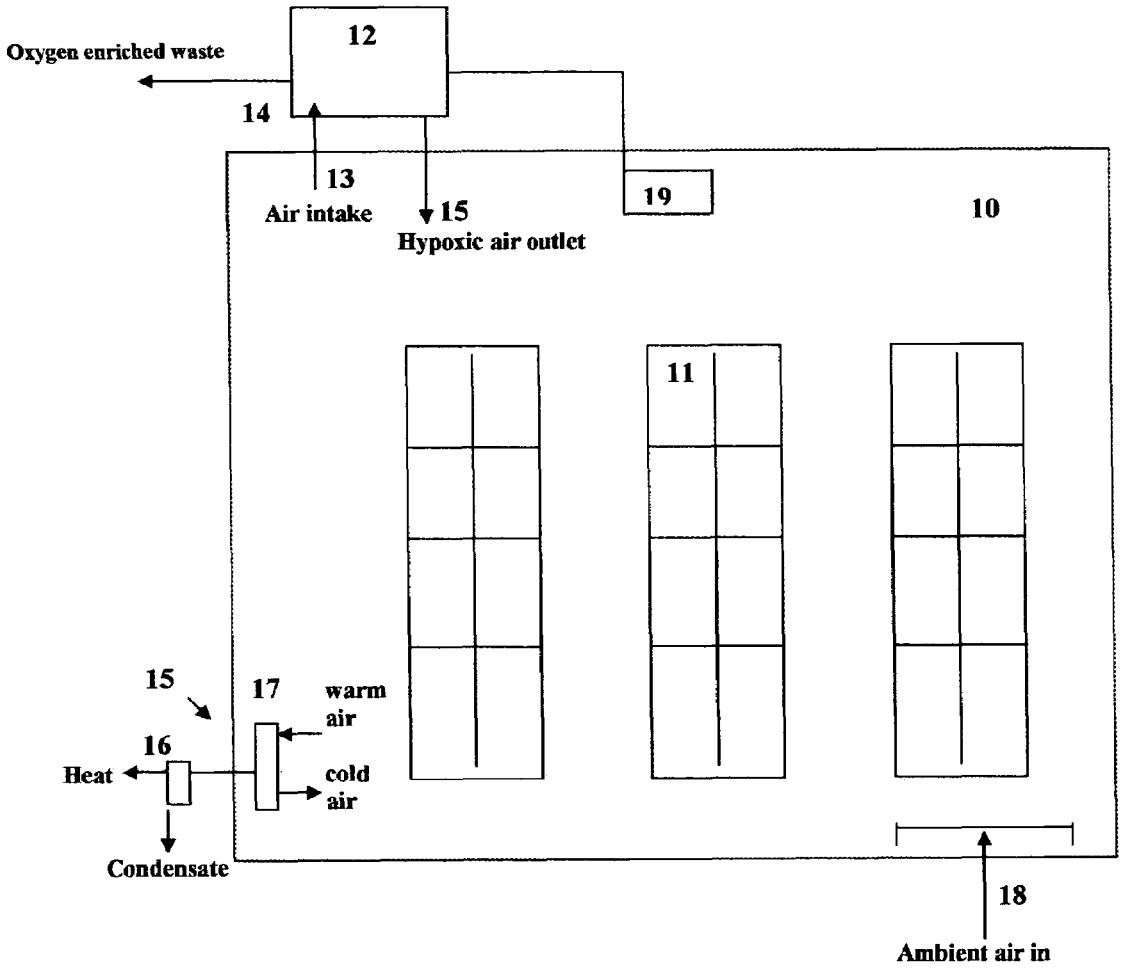
FIG. 2 shows an alternative installation option of the system shown on FIG. 1.

Air separation device 12 can be placed outside of the room 10, but still having intake 13 inside the room 10 and disposing oxygen-enriched fraction outside of the room 10. FIG. 2 illustrates this option of external installation of the air separation device 12.

Multiple generators 12 can be used by placing them in a special generator room with own a/c system. This is very convenient for larger facilities with multiple rooms 10. In this case larger air-conditioning systems should be installed, working however, only in recycling mode. Hypoxic generators will provide sufficient ventilation of such environments and fresh air supply. Some human accessible environments may have oxygen content from 9% to 14%, if they do not require constant presence by human operators. Every hypoxic generator is equipped with a HEPA (high efficiency particulate arrestance) filters that allow supplying dust free hypoxic air in order to substantially reduce dust accumulations on computer equipment, which also beneficial for fire prevention.

The invented method provides a unique technology of the preparation and maintaining of two breathable fire-suppressive compositions that are different from compositions described in previous patents provided above. Both compositions are a blend of a product of dilution of an internal atmosphere with hypoxic air and ambient air introduced in such internal environment.

Both breathable fire-preventative compositions being produced by gradually removing oxygen-enriched air from the internal room atmosphere and continuously replacing it with a hypoxic gas mixture having oxygen content that gradually drops until the internal atmosphere reaches a desired level between Low and High set points. For instance, an air separation device drawing internal atmosphere having 14% O2 will produce hypoxic gas mixture with oxygen content about 10-12% in the most energy-efficient set-up. At the same time ambient air is drawn into a room where it mixes with the internal atmosphere.

There are several technologies to create two different fire-preventative breathable compositions inside an enclosed room:

a) pressure-swing adsorption (e.g. using zeolites) to trap nitrogen molecules, water vapor and carbon dioxide and allowing dry oxygen-enriched air to pass through;
b) pressure-swing adsorption (e.g. using carbon molecular sieve materials) to trap oxygen molecules, water vapor and carbon dioxide, and allow dry nitrogen-enriched air to pass through;
c) membrane air separation that produces dry nitrogen rich retentate and oxygen rich permeate retaining most of the water vapor and carbon dioxide from the intake mixture;
d) temperature, electric charge and other swing adsorption processes allowing to receive the same two products described in a) and b);
e) cryogenic air separation and distillation that allows to produce absolutely pure and dry gases (in this case oxygen and nitrogen). This method would require evaporation and mixing of gases and will not be discussed further since it was described in full in U.S. Pat. No. 6,502,421.

Methods from a) to d) allow to produce two different hypoxic gas mixtures that can create two different breathable fire-preventative compositions, environments or atmospheres, which eventually being produced by mixing the hypoxic gas mixtures with the ambient air that is drawn into room 10 due to the pressure equalization effect or supplied by a blower. Normally, the amount of the ambient air is much less than amount of hypoxic gas mixture produced by air separation unit 12.

Consequently, we are able to create a breathable fire-preventative composition having less humidity and carbon dioxide content than the ambient atmospheric air at current location and a breathable fire-preventative composition having higher humidity (if no a/c unit installed) and carbon dioxide content than the ambient atmospheric air at current location. The standard carbon dioxide content in ambient clean atmospheric air is about 350 ppm (parts per million) or 0.035%, therefore both compositions can be clearly distinguished as a carbon dioxide enriched or hypercapnic (containing over 350 ppm of CO2) and a carbon dioxide depleted or hypocapnic (containing less than 350 ppm of CO2) compositions.

Method a) Hypercapnic: is recommended most for human visited facilities since humid air is good for respiration and carbon dioxide is a necessary breathing stimulant, increased concentration of which helps to counterbalance hypoxia in human body.

Methods b) and c) produce a slightly less user-friendly Hypocapnic product, but are still usable in all applications. Method c) is recommended for large buildings and structures.

Methods of category d) can produce both, hyper- and hypocapnic compositions, depending on an absorption material used.

Method e) will produce hypocapnic environment since it makes mostly pure gases and pure nitrogen will be used for dilution of the internal atmosphere.

Figure 3:
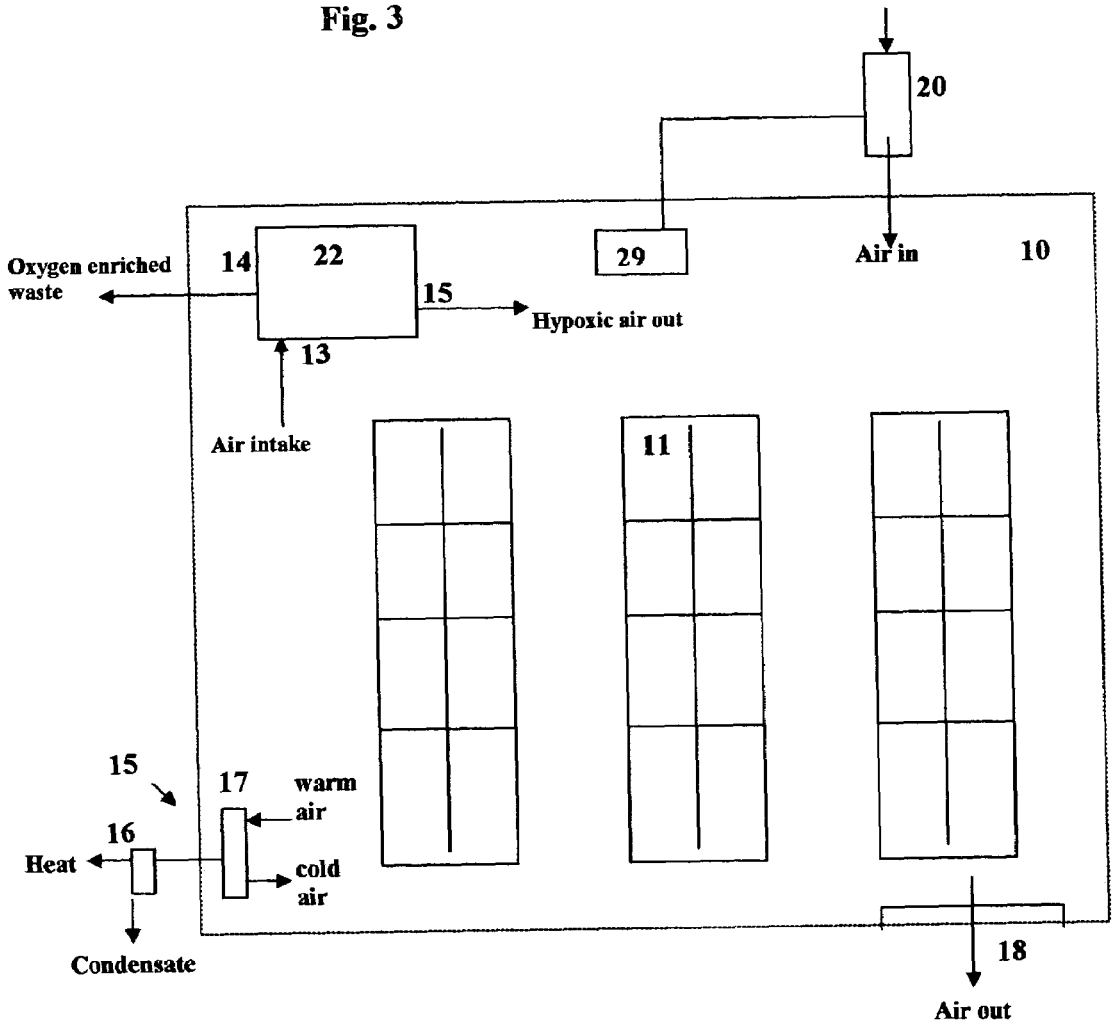
FIG. 3 illustrates schematically an alternative method of establishing a breathable normobaric hypoxic fire prevention environment in a computer room, warehouse or other normally occupied facility.

FIG. 3 shows schematically an alternative, less energy-efficient, embodiment of the equipment installation, whereby the air separation device 22 works continuously, without interruption and is not controlled by a control panel. In this case, control panel 29 controls a blower 20 that is turned on when oxygen content reaches Low set level and is turned off when High set level is achieved. Blowing fresh ambient air in by blower 20 allows maintaining the oxygen content at desired level between High and Low set points. This method is mostly recommended for normally occupied rooms and facilities where higher fresh air supply and ventilation rate is desired.

This method does not affect the above provided definitions of two major classes of breathable fire-preventative compositions and will still allow creating CO2 enriched (hypercapnic) and CO2 depleted (hypocapnic) compositions as described in methods a) to e).

Invented methods and compositions can be applied to any human occupied facility included but not limited to: rooms for data processing, telecommunication switches, process control and Internet servers; banks and financial institutions, museums, archives, libraries and art collections; military and marine facilities; aircraft, space vehicles and space stations, marine and cargo vessels; industrial processing and storage facilities operating with inflammable and explosive materials and compositions, and many other different application that require prevention of fire hazard. The invented methods and compositions will guarantee that no fire will start in such protected areas under any circumstances. More information can be obtained from www.firepass.com.

The invention claimed is:

1. A method for providing a breathable hypoxic hypercapnic fire-prevention atmosphere in a computer room, warehouse and other occupied facilities, such method comprising:

making said room substantially airtight by minimizing its leakage rate;

utilization of an air separation apparatus for separation of the internal atmosphere of said room into oxygen enriched and oxygen depleted fractions;

extracting said oxygen enriched fraction out of said internal atmosphere and transmitting it to a location where it does not mix with the internal atmosphere;

said apparatus producing the oxygen enriched fraction having carbon dioxide content below 0.035% and said oxygen depleted fraction having carbon dioxide content greater than 0.035%;

releasing said oxygen depleted fraction inside said room so it mixes with said internal atmosphere and depleting it until a desired breathable hypoxic hypercapnic environment is created having fire-preventative quality;

diluting said breathable environment with ambient atmospheric air entering said room;

maintaining automatically the oxygen content in said breathable hypoxic hypercapnic environment in a range greater than 12% and below 18%.

2. The method of claim 1, wherein:

said ambient atmospheric air being selectively supplied into said room by a fan or blower in order to maintain the internal oxygen content in a preset range.

3. The method of claim 1, wherein:

said ambient atmospheric air being selectively drawn into said room due to pressure difference and said air separation apparatus being selectively turned on and off by an automatic control in order to maintain the internal oxygen content in a preset range.

4. The method of claim 1, wherein:

said oxygen depicted fraction being released inside said room and depleting said internal atmosphere until a low set oxygen concentration level is reached;

said low set oxygen level being detected by an oxygen monitoring device that triggers a control panel to shut down the air separation apparatus;

the oxygen content in said internal atmosphere starts raising gradually and in a certain period of time, depending on the leakage rate of the room, it reaches a high set oxygen concentration level, which is detected by the monitoring device triggering said control panel to turn the air separation apparatus on;

the apparatus starts extracting the oxygen enriched fraction from the room atmosphere and the oxygen concentration inside the room drops again to the low set level, which triggers the panel to turn the air separation apparatus off;

this cycle continues repeatedly, allowing to keeping the oxygen content in the internal room atmosphere at a desired concentration between the low set level and the high set level.

5. The method of claim 1, wherein:

this method can be used in any room or facility containing computerized equipment or any combustible, inflammable or explosive materials.

6. A method for providing a breathable hypoxic hypocapnic fire-prevention atmosphere in a computer room, warehouse and other occupied facilities, such method comprising:

making said room substantially airtight by minimizing its leakage rate;

utilization of an air separation apparatus for separation of the internal atmosphere of said room into oxygen enriched and oxygen depleted fractions;

extracting said oxygen enriched fraction out of said internal atmosphere and transmitting it to a location where it does not mix with the internal atmosphere;

said apparatus producing the oxygen enriched fraction having carbon dioxide content greater than 0.035% and said oxygen depleted fraction having carbon dioxide content below 0.035%;

releasing said oxygen depleted fraction inside said room so it mixes with said internal atmosphere and depleting it until a desired breathable hypoxie hypocapnic environment is created baviug fire-preventative quality;

diluting said breathable covironment with ambient atmospheric air entering said room;

maintaining automatically the oxygen content in said breathable hypoxic hypocapnic environment in a range greater than 12% and below 18%.

7. The method of claim 6, wherein:

said ambient atmospheric air being selectively supplied into said room by a fan or blower in order to maintain the internal oxygen content in a preset range.

8. The method of claim 6, wherein:

said ambient atmospheric air being selectively drawn into said room due to a pressure difference and said air separation apparatus being selectively turned on and off by an automatic control in order to maintain the internal oxygen content in a preset range.

9. The method of claim 6, wherein:

said oxygen depleted fraction being released inside said room and depleting said internal atmosphere until a low set oxygen concentration level is reached;

said low set oxygen level being detected by an oxygen monitoring device that triggers a control panel to shut down the air separation apparatus;

the oxygen content in said internal atmosphere starts raising gradually and in a certain period of time, depending on the leakage rate of the room, it reaches a high set oxygen concentration level, which is detected by the monitoring device triggering said control panel to turn the air separation apparatus on;

the apparatus starts extracting the oxygen enriched fraction front the room atmosphere and the oxygen concentration inside the room drops again to the low set level, which triggers the panel to turn the air separation apparatus off;

this cycle continues repeatedly, allowing to keeping the oxygen content in the internal room atmosphere at a desired concentration between the low set level and the high set level.

10. The method of claim 6, wherein:

this method can be used in any room or facility containing computerized equipment or any combustible, inflammable or explosive materials.

11. A breathable hypoxic hypercapnic fire-preventative composition for use in an enclosed environment, said composition being produced by the dilution of an internal atmosphere with hypercapnic hypoxic air and mixing it with ambient atmospheric air introduced into said enclosed environment;

said composition being a blend of hypoxic hypercapnic air and abient atmospheric air for current location and having oxygen content in a range above 9% to 17% and carbon dioxide content greater than 0.035%;

said composition being used as a fire suppressive atmosphere in computer rooms, warehouses and other occupied and non-occupied enclosed environments.

12. The method of claim 11, wherein:

this breathable hypoxic hypereapnic fire-preventative composition being created for a use in any room or facility containing computerized equipment or any combustible, inflammable or explosive materials.

13. The method of claim 11, wherein:

said hypercapnic hypoxic air being produced by an air separation device from air in said enclosed environment or said ambient atmospheric air;

said ambient atmospheric air can be introduced into said enclosed environment via natural leakage or forced air supply.

14. A breathable hypoxic hypocapnic fire-preventative composition for use in an enclosed environment, said composition being produced by the dilution of an internal atmosphere with hypocapnic hypoxic air and mixing it with ambient atmospheric air introduced into said enclosed environment;

said composition being a blend of hypoxic hypocapnic air and ambient atmospheric air for current location and having oxygen content in a range greater than 9% to 17% and carbon dioxide content below 0.035%;

said composition being used as a fire suppressive atmosphere in computer rooms, warehouses and other occupied and non-occupied enclosed environments.

15. The method of claim 14, wherein:

this breathable hypoxic hypocapnic fire-preventative composition being created for a use in any room or facility containing computerized equipment or any combustible, inflammable or explosive materials.

16. The method of claim 14, wherein:

said hypocapnic hypoxic air being produced by an air separation device from air in said enclosed environment or said ambient atmospheric air;

said ambient atmospheric air can be introduced into said enclosed environment via natural leakage or forced air supply.

* * * * *